US005866828A

United States Patent [19]

Huang

[11] Patent Number: 5,866,828

[45] Date of Patent: Feb. 2, 1999

[54] MUSICAL BOX

[76] Inventor: Chia-Teng Huang, P.O. Box 82-144, Taipei, Taiwan

[21] Appl. No.: 785,790

[22] Filed: Jan. 21, 1997

[51] Int. Cl.[6] ..... G10F 1/06

[52] U.S. Cl. ..... 84/95.1; 84/95.2; 84/94.1; 84/94.2

[58] Field of Search ..... 84/94.1, 94.2, 84/97, 95.1, 95.2, 96; 446/297, 298, 106

[56] References Cited

U.S. PATENT DOCUMENTS

| | | | |
|---|---|---|---|
| 5,430,238 | 7/1995 | Chen | 84/95.2 |
| 5,510,571 | 4/1996 | Chen | 84/95.2 |
| 5,523,523 | 6/1996 | Chen | 84/95.2 |
| 5,561,253 | 10/1996 | Chen | 84/95.2 |
| 5,571,979 | 11/1996 | Chen | 84/95.2 |

*Primary Examiner*—William M. Shoop, Jr.
*Assistant Examiner*—Kim Lockett
*Attorney, Agent, or Firm*—A & J

[57] ABSTRACT

A musical box including a base, a seat having a casing and fixedly mounted on the base, a spiral spring fitted within the casing, a drum having a first end and a second end and drum including a plurality of protuberances thereon, a gear fixedly mounted on the first end of the drum, a gear train connected to the spring and engaging the gear, a hitting member fixedly mounted on the seat and having a plurality of tines in contact with the drum, a fixed plate fixedly mounted on the seat and formed with two horizontal slots and a circular hole between the slots, a movable plate having two upright arms at two opposite ends and slidably engaged with the fixed plate by two guiding members extending through the slots to engage with the movable plate, the drum being provided at second end with an axle extending through the movable plate and the circular hole of the fixed plate to engage with a disk, the disk having an eccentric hole engaged with an end of a crank, and the crank having another end connected with one of the guiding members.

1 Claim, 5 Drawing Sheets

MUSICAL BOX

BACKGROUND OF THE INVENTION

1. Field of the Invention

This invention relates to an improved musical box.

2. Description of the Prior Art

It has been found that the conventional musical box is simply a box with a mechanical device that produces a tune when the box is opened. However, such a musical box is monotonous and too complicated in structure thereby increasing the cost thereof.

Therefore, it is an object of the present invention to provide a musical box which may obviate and mitigate the above-mentioned drawbacks.

SUMMARY OF THE INVENTION

This invention relates to an improved musical box.

It is the primary object of the present invention to provide a musical box which will cause a doll to reciprocate when producing music.

It is another object of the present invention to provide a musical box which is simple in construction.

It is still another object of the present invention to provide a musical box which is compact in size.

It is still another object of the present invention to provide a musical box which is amusing and interesting.

It is a further object of the present invention to provide a musical box which is economic to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
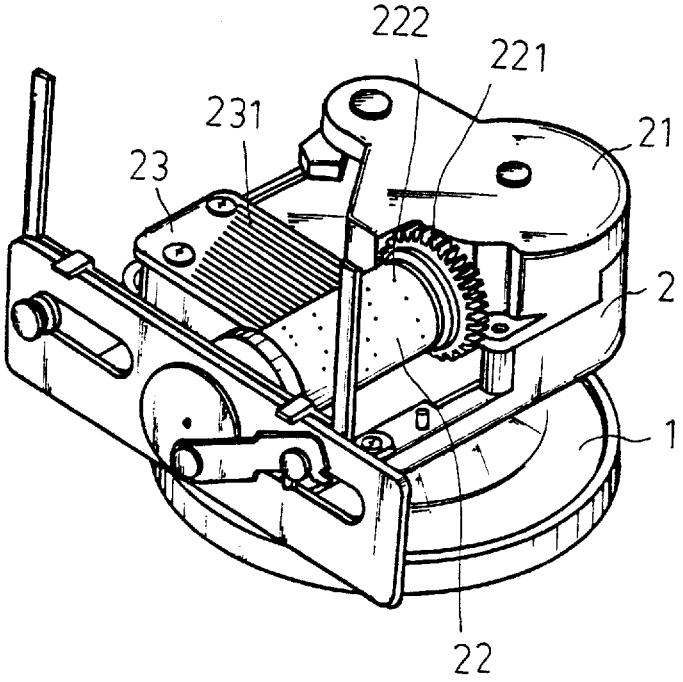
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
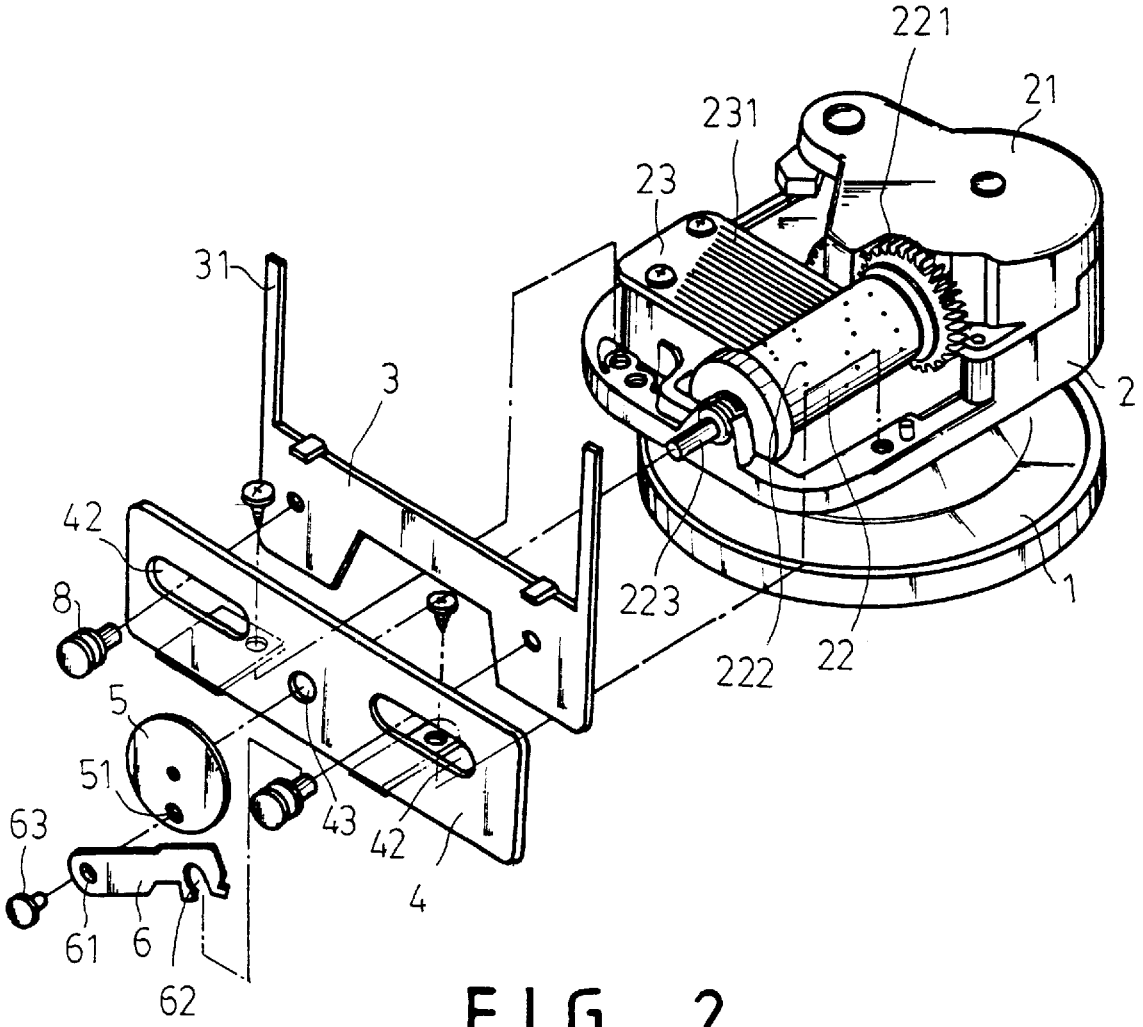
FIG. 2 is an exploded view of the present invention.
Figure 3:
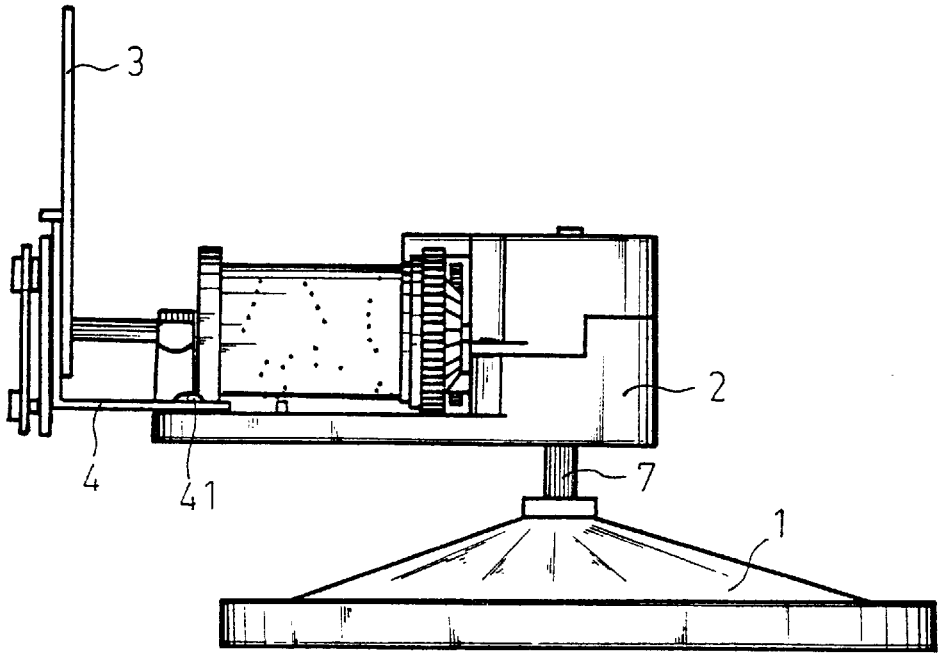
FIG. 3 is a side view of the present invention.

With reference to the drawings and in particular to FIGS. 1, 2 and 3 thereof, the musical box according to the present invention mainly comprises a base 1, a seat 2, a movable plate 3, a fixed plate 4, a disk 5 and a crank 6.

As illustrated, a casing 21 is mounted on the seat 2, in which is fitted a spiral spring (not shown). The spiral spring is connected with a turning rod 7 (see FIG. 3) which extends downwardly out of the casing 21 and the seat 2. The lower end of the turning rod 7 is fixedly mounted on the base 1 so that the seat 2 will be rotated with respect to the base 1 when the base 1 is rotated to turn the spiral spring tight and then released. Further, the spiral spring is connected with a gear train (not shown) so that the spiral spring will drive the gear train to rotate. The gear train is in turn engaged with a gear 221 which is fixedly mounted on one end of a drum 22 formed with a plurality of protuberances 222 thereon. A hitting member 23 having a plurality of tines 231 is fixedly mounted on the seat 2, with its tines 231 contacting the surface of the drum 22. The fixed plate 4 is an elongated member formed with two horizontal slots 42 and a circular hole 43 between the two slots 42. The fixed plate 4 is fixedly mounted on the seat 2 by screws 41 (see FIG. 3). The movable plate 3 is slidably arranged on the rear side of the fixed plate 4 and provided with two upright arms 31 at two opposite ends. Two guiding members 8 extend through the two slots 42 of the fixed plate 4 to fixedly engage with the movable plate 3 so that the movable plate 3 can be moved with respect to the fixed plate 4. The drum 22 is provided with an axle 223 which extends through the circular hole 43 of the fixed plate 4 to engage with the disk 5 so that the disk 5 will be rotated in unison with the axle 223. The disk 5 has an eccentric hole 51 connected with an end 61 of the crank 6 by a screw 63. The other end of the crank 6 has a notch 62 engaged with one of the guiding members 8.

Figure 4:
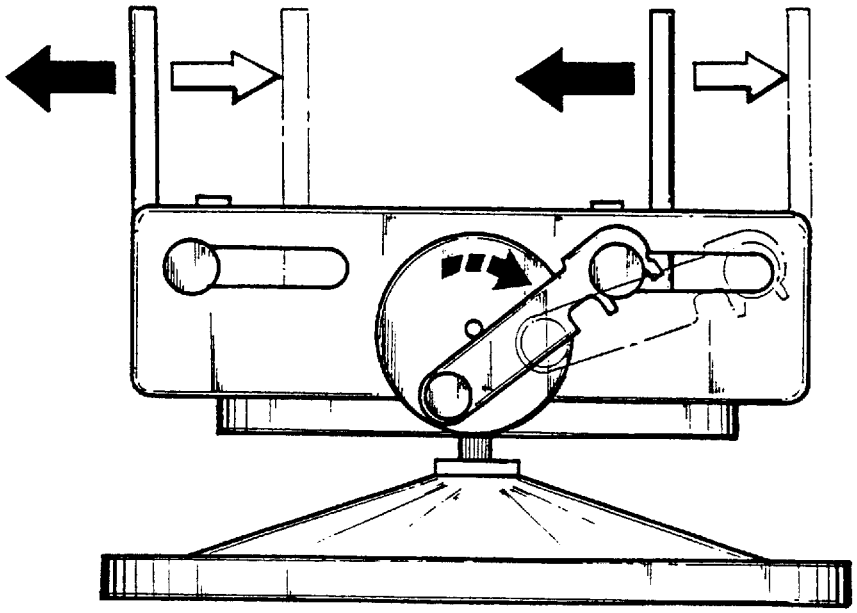
FIGS. 4 and 5 illustrate the working principle of the present invention.
Figure 5:
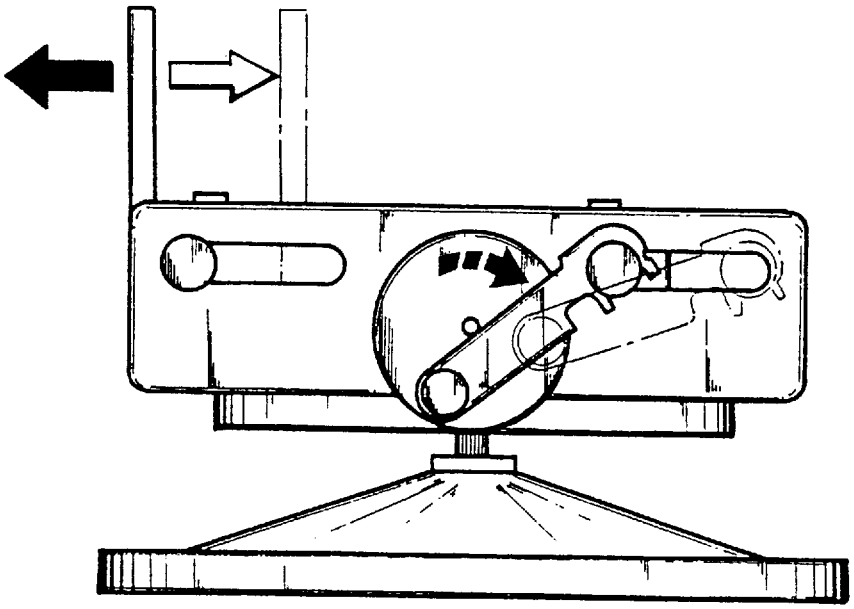

FIGS. 4 and 5 illustrate the working principle of the present invention. As illustrated, when desired to produce music, simply turn the base 1 to turn the spiral spring tight and release the base 1. Then, the spiral spring will drive the gear train which will in turn drive the gear 221 thereby rotating the drum 22. As the drum 22 is rotated, the tines 231 of the hitting member 23 will hit the protuberances 222 of the drum 22 hence producing music. In the meantime, the axle 223 will rotate the disk 5. When the disk 5 is rotated, the movable plate 3 will be reciprocated by the crank 6 thereby causing the doll (not shown) mounted on the upright arm 31 of the movable plate 3 to move to and fro.

Figure 6:
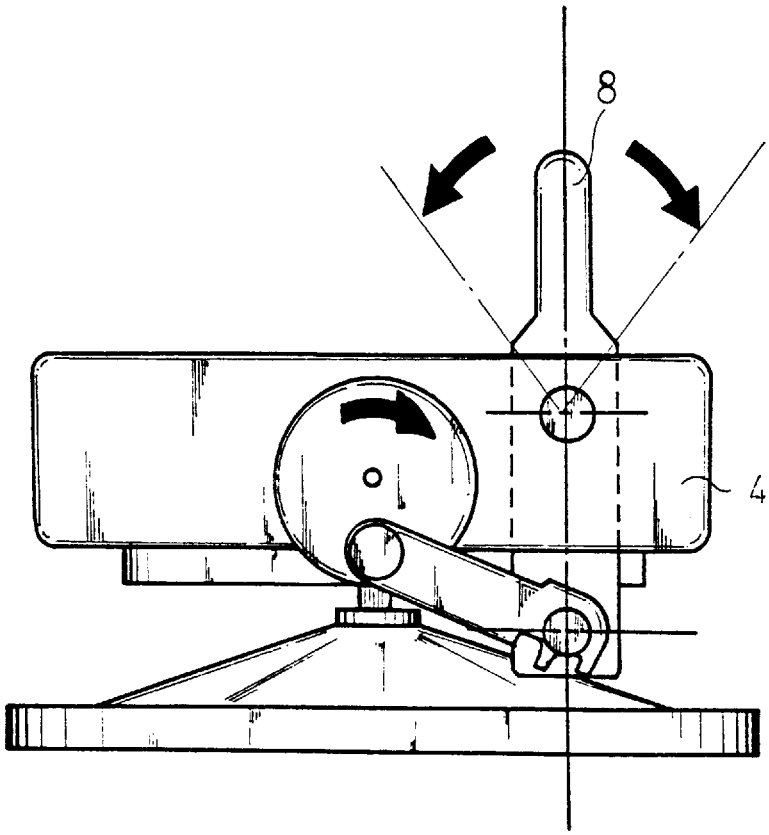
FIG. 6 shows a second preferred embodiment of the present invention.

FIG. 6 shows a second preferred embodiment of the present invention. As illustrated, the movable plate 3 is replaced with an oscillating rod 8 which is pivotally mounted on the fixed plate 4 so that the oscillating rod 8 will oscillate with respect to the fixed plate 4.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A musical box comprising:

a base;

a seat having a casing and fixedly mounted on said base;

a spiral spring fitted within said casing;

a drum having a first end and a second end and drum including a plurality of protuberances thereon;

a gear fixedly mounted on said first end of said drum;

a gear train connected to said spring and engaging said gear;

a hitting member fixedly mounted on said seat and having a plurality of tines in contact with said drum;

a fixed plate fixedly mounted on said seat and formed with two horizontal slots and a circular hole between said slots;

a movable plate having two upright arms at two opposite ends and slidably engaged with said fixed plate by two guiding members extending throught said slots to engage with said movable plate;

said drum being provided at second end with an axle extending through said movable plate and said circular hole of said fixed plate to engage with a disk;

said disk having an eccentric hole engaged with an end of a crank; and said crank having another end connected with one of said guiding members.

* * * * *